United States Patent [19]

Mino et al.

[11] 4,438,887

[45] Mar. 27, 1984

[54] GROOVED TRAVERSE DRUM FOR USE IN DRUM WINDER

[75] Inventors: Masao Mino; Takeshi Ohno, both of Yao, Japan

[73] Assignee: Kabushiki Kaisha Mino Seisakusho, Osaka, Japan

[21] Appl. No.: 372,004

[22] Filed: Apr. 26, 1982

[51] Int. Cl.[3] ..... B65H 54/48

[52] U.S. Cl. ..... 242/43.2

[58] Field of Search ..... 242/43.2

[56] References Cited

U.S. PATENT DOCUMENTS 3,022,021 2/1962 Zollinger ..... 242/43.2

3,346,206 10/1967 Fossen ..... 242/43.2

FOREIGN PATENT DOCUMENTS 1072825 6/1967 United Kingdom ..... 242/43.2

*Primary Examiner*—Stanley N. Gilreath

*Attorney, Agent, or Firm*—Armstrong, Nikaido, Marmelstein & Kubovcik

[57] ABSTRACT

A grooved traverse drum for use in a drum winder incorporates a cylindrical abrasion-resistant piece which is slantwise inserted therein in a shallow yarn guide groove portion. The cylindrical abrasion-resistant piece elongates substantially in the direction in which the shallow yarn guide groove portion extends. Such abrasion-resistant piece has a notch or indentation formed in its one end peripheral surface and is positioned with respect to the shallow groove portion such that the notch takes place substantially the whole of the shallow groove portion at the crossover point such that yarn guided by this shallow groove portion only contacts the notch in the abrasion-resistant piece.

11 Claims, 6 Drawing Figures

GROOVED TRAVERSE DRUM FOR USE IN DRUM WINDER

This invention relates to a grooved traverse drum for use in a drum winder for winding parallel cheeses or cone cheeses. The grooved traverse drum has a spiral yarn guide groove in the peripheral surface thereof, the yarn guide groove including at least one crossover point where a shallow groove portion is interrupted by a deep groove portion.

It is known in the art that the grooved traverse drum (hereinafter referred to simply as the drum) is subject to abrasion, though small in amount, at different places in the yarn guide groove, especially at the crossover points and the reversal points, owing to the frequent repetition of friction between the drum and the yarn being wound, such abrasion forming a cause of yarn breaks and hence deterioration in yarn quality.

In an effort to prevent such abrasion, there have heretofore been proposed the use of an abrasion-resistant piece to be inserted into the drum in the crossover point of the yarn guide groove where the abrasion is severe.

For example, there are a method in which a semi-circular plate-like abrasion-resistant piece is inserted in the bottom of the interrupted yarn guide groove portion at the crossover point (hereinafter referred to as the first method for convenience of description); another method in which a cylindrical abrasion-resistant piece is inserted in the drum in the interrupted yarn guide groove portion at the crossover point perpendicularly to the axis of rotation of the drum from the drum surface (hereinafter referred to as the second method for convenience of description); and a further method in which an abrasion-resistant piece is inserted in the drum across the shallow yarn guide groove portion just before the crossover point slantwise from the drum surface (hereinafter referred to as the third method for convenience of description).

According to the first method, however, it is impossible to provide the abrasion-resistant piece with a notch or indentation which should form a sufficient part of the yarn guide groove, with the result that the yarn will slip out of the notch or indentation in the abrasion-resistant piece and travel across the boundary between the abrasion-resistant piece and the drum constituting material, thereby producing an abrasion in the drum constituting material.

Further, since the abrasion-resistant piece used in the first method is in the form of a thin plate, the notch formed in the abrasion-resistant piece terminates in a short distance along the yarn running direction, so that there is the disadvantage of an abrasion being produced in the drum constituting material at the boundary between the drum constituting material and the abrasion-resistant piece.

Further, according to the first method, when a notch of rectangular cross-section for receiving the abrasion-resistant piece of also rectangular cross-section is formed in the drum, the drum constituting material confining the hole and forming the sidewalls of the interrupted groove portion becomes so thin that this thin portion can hardly be prevented from deforming during the formation of the hole. As a result, when the abrasion-resistant piece is inserted in the hole, a clearance is produced at the boundary between the abrasion-resistant piece and the drum constituting material. It has been a usual practice to fill such clearance with an adhesive agent, but, during the use, such adhesive agent will worn out too early and the boundary portions will appear in the form of sharp edges, bringing about disadvantages, such as deterioration in yarn quality and a lowering of production efficiency of the drum winder.

With the second method, a step is gradually formed at the boundary between the abrasion-resistant piece and the drum constituting material owing to the abrasion of the drum constituting material and such steps cause incorrect traverse and damage to the yarn which, in turn, causes deterioration in yarn quality and yarn breaks which lead to the yarn wrapping around the drum, thus lowering the production efficiency of the drum winder. Another disadvantage of the second method is that since there is the danger of the abrasion-resistant piece being thrown out by centrifugal force, the greatest possible care is required in machining, which involves high cost.

With the third method, since the yarn travels across the boundary between the abrasion-resistant piece and the drum constituting material forming the groove bottom, portions of the drum constituting material are rubbed and damaged, bringing about disadvantages, such as deterioration in yarn quality and a lowering of production efficiency of the drum winder.

The present invention has for its object the provision of an improved grooved traverse drum for use in a drum winder which is capable of eliminating the above described disadvantages.

According to the invention, abrasion-resistant pieces are inserted and bonded in the drum in the yarn guide groove at portions subject to the severest abrasion by the yarn in such a manner that the boundary between the drum constituting material and the abrasion-resistant material is spaced away from such portions as referred to as much as possible so that the portions are formed substantially exclusively by the abrasion-resistant material. More particularly, the shallow yarn guide groove portions interrupted by the deep yarn guide groove portion at the crossover point where the yarn take-up tension is highest are substantially wholly formed by the abrasion-resistant material, thereby eliminating the prior art disadvantages described above.

Another object of the invention is to provide a grooved traverse drum capable of facilitating the positioning of the abrasion-resistant piece in relation to the yarn guide groove. To that end, the abrasion-resistant piece takes the form of a cylinder; which permits such positioning of the piece with respect to the interrupted shallow groove portion that one of the side walls of the notch that serves as a guide for the yarn entering the shallow groove portion may be somewhat indented beneath the side wall surface of the shallow groove pontion, while the other that serves as a guide for the yarn passing out of the shallow groove portion may be somewhat raised on the side wall surface of that shallow groove portion.

Further objects of the invention are to facilitate the formation of a hole in the drum constituting material for receiving the abrasion-resistant piece therein; to prevent the deformation of the drum constituting material confining the hole; and to prevent the abrasion-resistant piece inserted and fixed in the hole from being thrown out by the centrifugal force during the rotation of the drum.

Still a further object of the invention is to ensure the proper guiding of the yarn passing across the interrupted shallow groove portions.

Still a further object of the invention is to facilitate the positioning of the abrasion-resistant piece in relation to the surface of the yarn guide groove by spacing the bottom of the notch in the abrasion-resistant piece from that of the yarn guide groove.

These and other objects and features of the invention will be more apparent from the following description of the preferred embodiment thereof given in conjunction with the accompanying drawing, in which.

Figure 1:
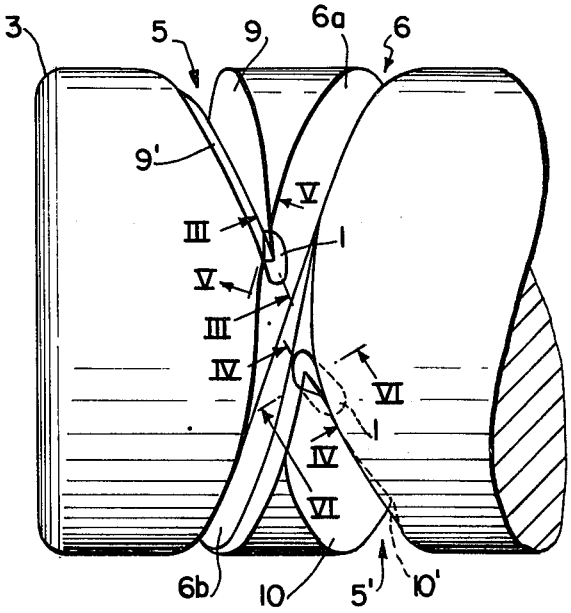
FIG. 1 shows a portion of a grooved traverse drum embodying the invention.

FIGS. 3, 4, 5, and 6 are sectional views taken along the lines III—III, IV—IV, V—V, and VI—VI in FIG. 1, respectively.

Figure 2:
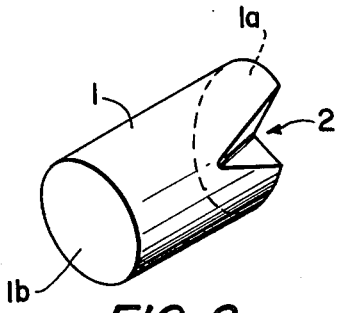
FIG. 2 is a perspective view of an abrasion-resistant piece to be incorporated in the drum of FIG. 1.

Referring to FIGS. 1 and 2, the numeral 1 generally designates an abrasion-resistant piece and 2 designates a notch or indentation formed in the outer peripheral surface of the abrasion-resistant piece so as to take the place of the bottom and opposite lateral walls of a yarn guide groove portion.

The abrasion-resistant piece 1 is made of hard material, e.g., ceramic metal, and takes the form of a circular cylinder. Considering the machining process for forming holes for receiving the abrasion-resistant pieces therein, the cylindrical form is thought to be advantageous, because with this form the holes can be easily formed in the drum by use of a drill.

Figure 3:
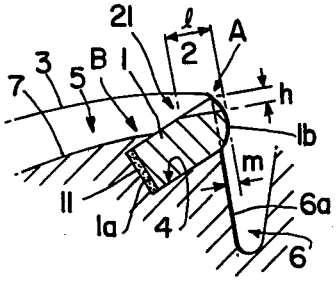
Figure 4:
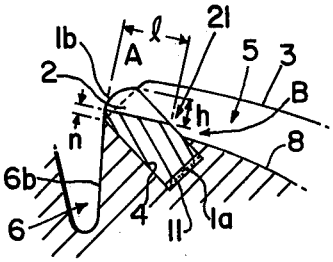

In addition, one end face 1*a* of the abrasion-resistant piece 1 may take various shapes depending upon the shape of the innermost part (bottom) of hole 4 formed in the drum 3, as shown in FIGS. 3 and 4. In the drawing, this end face is shown as having a flat face. However, it may have a conical end face as for example.

The other end face 1*b* of the abrasion-resistant piece 1 forms part of the lateral wall 6*a* or 6*b* of a deep yarn guide groove portion 6 at a crossover point. In the illustrated embodiment, the hole 4 is slantwise formed in the drum 3, as shown in FIGS. 3 and 4, and the end face 1*b* of the abrasion-resistant piece 1 is shown in the form of a semi-spherical surface slightly projecting on the lateral wall 6*a* or 6*b* of the deep groove portion 6 by a distance indicated at m or n. Thus, it is ensured that the yarn bridging the interrupted groove portion is properly guided since the end face 1*b* of the abrasion-resistant piece 1 is semispherical and projects as indicated at m and n, substantially minimizing the distance for which the yarn should bridge.

Figure 5:
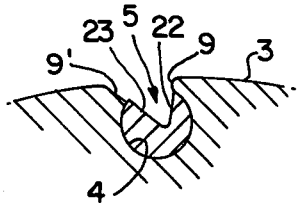
Figure 6:
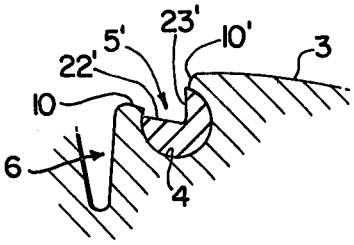

The notch or indentation 2 is formed on the side on which the end face 1*b* exists so that in the abrasion-resistant piece inserted in the drum, this notch may take the place of substantially the whole of each yarn guide groove portion 5 or 5′ at the crossover point where they are interrupted by the deep groove portion 6. Specifically, the bottom 21 of the notch 2 is, as seen in FIGS. 3 and 4, spaced from or not aligned with the bottom 7 of the groove portion 5 or 5′. The notch 2 has a V-shaped cross-section, the legs of the V forming side walls. The cylindrical form of the abrasion-resistant piece facilitates the positioning of the piece with respect to the interrupted shallow yarn guide groove portion: The side wall 22 which serves as a guide for the yarn entering the groove portion 5 is, as seen in FIG. 5, somewhat indented beneath the side wall 9, while the side wall 23 which serves as a guide for the yarn passing out of the groove portion 5, is somewhat raised on the side wall 9′. Similarly, as seen in FIG. 6, the side wall 22′ which serves as a guide for the yarn entering the groove portion 5′, is somewhat indented beneath the side wall 10, while the side wall 23′ which serves as a guide for the yarn passing out of the groove portion 5′, is somewhat raised on the side wall 10′.

As for the depth of the notch or indentation 2 formed in the abrasion-resistant piece 1, it has been experimentally found that satisfactory result can be attained with a depth of as little as 0.5 mm in the deepest place in the notch or indentation 2, though depending upon the depth of the groove portion 5 or 5′ where the piece 1 is inserted.

In order to reduce the cost of material for the abrasion-resistant piece 1, it is advisable to reduce the size as much as possible, but on the other hand, in order to reduce the amount of abrasion given to the drum constituting material by the yarn, the size must be increased to some degree. Ideally, therefore, a certain size and shape will be determined, but these must be understood to naturally have a suitable range.

The hole 4 by which to insert and fix the abrasion-resistant piece 1 into the drum 3 is slantwise formed to have an angle of inclination of about 30° to 60° with the bottom 7 or 8 of the groove portion 5 or 5′, as shown in FIGS. 3 and 4, This specific range of the angle of inclination is given here only for convenience of description and does not have any special and important meaning, but if the angle is smaller than 30°, the thickness of the drum constituting material between the bottom 7 or 8 and the recess 4 is decreased and is in danger of being deformed, while if it is greater than 60°, the thickness of the drum constituting material between the lateral wall 6*a* or 6*b* of the groove portion 6 and the hole 4 is decreased and is in danger of being deformed. In this sense, the range given above only indicates a criterion.

As for the direction in which the hole 4 is formed, it is thought to be best to form it along the direction in which the bottom 7 or 8 of the groove portion 5 or 5′ extends, but this direction of formation may be somewhat changed if there are restrictions from the standpoint of machining or if there is a possibility that the thickness of the drum constituting material confining the recess or hole 4 will be decreased unless that direction is so changed.

In addition, the abrasion-resistant piece 1 is slantwise inserted in the hole 4 from a position nearest to the surface of the drum 3 and is fixed in position, so that the groove bottom and opposite lateral walls at the place where the severest abrasion takes place when the yarn is guided in a bridge fashion between the groove portions 5 and 5′ interrupted by the groove portion 6 are formed substantially exclusively by the notch or indentation 2 of the abrasion-resistant material. Particularly, not only the groove bottom but also the opposite lateral walls extending almost to the surface of the drum 3 are formed by the abrasion-resistant material. Therefore, the yarn is smoothly guided as it transverses without any possibility of slipping out of the notch or indentation 2, so that there is no danger of the drum constituting material in this portion being abraded.

In addition, in order to fix the abrasion-resistant piece 1 in the hole 4 of the drum 3, it is easy to do so by using an adhesive agent 11, but other fixing means may be used.

So long as the boundary position A shown in FIGS. 3 and 4 does not appear on the drum surface, the boundary between the drum constituting material and the abrasion-resistant material will be located in the lateral wall 6*a* or 6*b* of the deep yarn guide groove portion 6. Therefore, no step due to abrasion will be produced and hence there will be no problems, such as incorrect traverse of the yarn, deterioration in yarn quality, and a lowering of production efficiency due to yarn breaks.

Further, since the abrasion-resistant piece 1 is inserted in the drum slantwise with respect to the drum surface and fixed in position, there is almost no danger of the abrasion-resistant piece being thrown out by the centrifugal force due to the rotation of the drum during the use, and the machining is easy and inexpensive.

Further, the length (see FIGS. 3 and 4) of the groove bottom of the notch or indentation 2 in the abrasion-resistant piece 1 is longer because of the slantwise insertion of the piece than when it is inserted radially toward the drum center from the drum surface and fixed in position. As a result, the boundary position B is spaced away from the place where the abrasion is severest, and that the marginal region B of the drum constituting material is also spaced away from the bottom 21 of the notch 2 formed in the abrasion-resistant piece 1, so that there is no possibility of an abrasion being produced in the drum constituting material at that region B.

Further, since there is no possibility that the thickness of the drum constituting material forming the circumferential region around the hole 4 formed in the drum 3 is decreased, no deformation takes place and there is no possibility of a clearance being formed between the hole 4 and the abrasion-resistant piece 1. There is no possibility that the drum constituting material wears out too early at the boundary between the drum constituting material and the abrasion-resistant material, so that there are no troubles, such as deterioration in yarn quality, and a lowering of production efficiency of the drum winder due to yarn breaks.

According to the present invention, described so far, even if the groove is particularly shallow, a satisfactory yarn guide groove portion substantially the whole of which is formed by the notch or indentation in the abrasion-resistant piece is provided. Consequently, there being no possibility of yarn slipping out beyond the abrasion-resistant material, the yarn can be smoothly guided as it travels, with the proper guide for the yarn bridging the interrupted groove portions being ensured. There is no possibility of incorrect traverse of the yarn and a lowering of production efficiency of the drum winder, and the usual life of the drum can be prolonged. The machining is comparatively easy and inexpensive. Thus, it is possible to provide a highly effective grooved traverse drum for use in a drum winder.

While a specific embodiment of the invention has been described in detail with reference to the accompanying drawing, it is to be understood that the invention is not limited thereto and that various changes and modifications may be made by those skilled in the art without departing from the spirit and scope of the invention.

What is claimed is:

1. A grooved traverse drum having a spiral yarn guide groove in the peripheral surface thereof, the yarn guide groove including at least one crossover point where a shallow groove portion is interrupted by a deep groove portion, said deep groove portion having sidewalls, wherein a cylindrical abrasion-resistant means is inserted into said drum in the interrupted shallow groove portion, said cylindrical abrasion-resistant means having a notch forms substantially the whole of the shallow groove portion at the crossover point such that yarn guided by said shallow groove portion only contacts the notch in said abrasion-resistant means, wherein said notch in the abrasion-resistant means has a V-shaped cross-section defining two legs of a V, taking the place of the interrupted shallow groove portion at the crossover point, and one of the legs of the V of the notch that serves as a guide for the yarn entering the shallow groove portion, is raised on the drum constituting material, while the other leg of the V that serves as a guide for the yarn passing out of the shallow groove portion, is indented beneath the drum constituting material.

2. A grooved traverse drum as set forth in claim 1, wherein the bottom of said notch is spaced apart from the bottom of said interrupted groove portion.

3. A grooved traverse drum as set forth in claim 1, wherein one end of said abrasion-resistant means is semispherical and appears in one of the side walls of said deep groove portion.

4. A groove traverse drum as set forth in claim 3, wherein said semispherical end of the abrasion-resistant means is raised on the side wall of the deep groove portion.

5. A grooved traverse drum having a spiral yarn guide groove in the peripheral surface thereof said spiral groove having a deep groove portion and a shallow groove portion, said deep and shallow groove portions intersecting at an intersection point, the shallow groove portion having an interruption therein at said intersection point, and abrasion resistant means, including a cylindrical portion, inserted into said drum in the shallow groove portion thereof, said abrasion resistant means having a notch therein, said notch being positioned with respect to said shallow groove portion such that the bottom of said notch is positioned above the bottom of said shallow groove portion and the sides of said notch are positioned with respect to the sides of said groove such that the top of one side edge of the notch is above the side surface of the groove on the side thereof which guides the yarn, the end face of said abrasion resistant means extending beyond the side wall of the deep groove portion, wherein the yarn guided by said shallow groove portion contacts only the bottom and side of said notch in said abrasion resistant means at the interruption of said shallow groove portion and at the adjoining edges of said abrasion resistant means and said drum.

6. A grooved traverse drum as set forth in claim 5, wherein the notch in said abrasion resistant means has a V-shaped cross-section.

7. A grooved traverse drum as set forth in claim 5 or 6, wherein said abrasion resistant means is inserted into said drum at the interruption of said shallow groove portion and at an angle with respect to the bottom of said shallow groove portion.

8. A grooved traverse drum as set forth in claim 5 or 6, wherein said cylindrical portion has a length greater than the diameter thereof.

9. A grooved traverse drum as set forth in claim 5 or 6, wherein the top of the other side edge of the notch is below the side surface of the groove.

10. A grooved traverse drum as set forth in claim 5 or 6, wherein the end face of said abrasion resistant means is semispherical.

11. A grooved traverse drum as set forth in claim 5 or 6, wherein the axis of said abrasion resistant means is inclined with respect to the axis of said drum at an angle of 30° to 60°.

* * * * *